US008468783B2

(12) United States Patent
Uebler et al.

(10) Patent No.: US 8,468,783 B2
(45) Date of Patent: Jun. 25, 2013

(54) POUCH TRANSPORT GRIPPERS

(75) Inventors: Randy M. Uebler, Bradenton, FL (US); Fred Freed, North Port, FL (US); Huy Do, Valrico, FL (US); Tamas Szalkai, Lakewood Ranch, FL (US)

(73) Assignee: Mamata Enterprises, Inc., Montgomery, IL (US)

( * ) Notice: Subject to any disclaimer, the term of this patent is extended or adjusted under 35 U.S.C. 154(b) by 208 days.

(21) Appl. No.: 13/194,074

(22) Filed: Jul. 29, 2011

(65) Prior Publication Data

US 2013/0025240 A1 Jan. 31, 2013

(51) Int. Cl.
*B65B 43/28* (2006.01)
*B65B 43/26* (2006.01)

(52) U.S. Cl.
USPC ..... 53/457; 53/564; 53/384.1; 53/570; 493/309

(58) Field of Classification Search
CPC ..... B65B 43/32; B65B 43/28; B65B 43/26
USPC ..... 53/457, 459, 564, 569, 576, 381.5, 53/387.1, 381.3, 384.1, 284.7, 570; 493/307, 493/317
See application file for complete search history.

(56) References Cited

U.S. PATENT DOCUMENTS

| | | | | |
|---|---|---|---|---|
| 4,750,695 | A | 6/1988 | Greenhouse | |
| 4,881,706 | A | 11/1989 | Sedlik | |
| 4,998,694 | A | 3/1991 | Barteaux | |
| 5,182,898 | A * | 2/1993 | Tung et al. | 53/570 |
| 6,276,117 | B1 * | 8/2001 | Wiles | 53/570 |
| 6,889,482 | B2 * | 5/2005 | Edwards et al. | 53/384.1 |
| 6,895,726 | B2 * | 5/2005 | Pinto et al. | 53/384.1 |
| 7,584,593 | B2 * | 9/2009 | Murray | 53/564 |
| 7,611,102 | B2 | 11/2009 | Murray | |
| 7,882,685 | B2 * | 2/2011 | Koga et al. | 53/570 |
| 7,954,307 | B2 * | 6/2011 | Paunesku et al. | 53/459 |
| 8,122,684 | B2 * | 2/2012 | Kurz et al. | 53/284.7 |
| 8,151,543 | B2 * | 4/2012 | Veix | 53/64 |
| 2001/0015056 | A1 * | 8/2001 | Hiramoto et al. | 53/479 |
| 2006/0016154 | A1 * | 1/2006 | Rogers | 53/410 |
| 2006/0162291 | A1 * | 7/2006 | Gates et al. | 53/459 |

(Continued)

OTHER PUBLICATIONS

International Search Report and Written Opinion issued on Nov. 23, 2012 for corresponding international PCT Application No. PCT/US2012/048817 with an international filing date of Jul. 30, 2012.

*Primary Examiner* — Alexandra Elve
*Assistant Examiner* — Eyamindae Jallow
(74) *Attorney, Agent, or Firm* — Ronald E. Smith; Smith & Hopen, P.A.

(57) ABSTRACT

A pouch-gripping apparatus includes a frame having a vertical mounting surface and a base mounted to that surface. A stationary arm projects outwardly from the vertical mounting surface. The stationary arm has an "L"-shaped distal free end that defines a stop wall. A second arm is rotatably mounted to the stationary arm and a plug is secured to the free end of the second arm. The second arm has a position of repose where it is angled relative to the stationary arm. The plug bears against the stop wall when the second arm rotates from the position of repose to a substantially horizontal position. A rim of a pouch sandwiched between the plug and the stop wall is held by the pressure between the plug and the stop wall and the pressure increases as a weight of the pouch increases.

6 Claims, 3 Drawing Sheets

U.S. PATENT DOCUMENTS

2007/0089377 A1* 4/2007 Yasuhira ..... 53/403
2012/0096812 A1* 4/2012 Ejeblad et al. ..... 53/452
2012/0144779 A1* 6/2012 Brinkman et al. ..... 53/432
2012/0192524 A1* 8/2012 Streett et al. ..... 53/79

* cited by examiner

POUCH TRANSPORT GRIPPERS

BACKGROUND OF THE INVENTION

1. Field of the Invention

This invention relates, generally, to machinery. More particularly, it relates to mechanical grippers that engage flexible pouches.

2. Description of the Prior Art

Flexible pouches are in widespread use for holding a wide variety of products. Typically, a form, fill and seal machine includes multiple mechanical pouch gripper assemblies of metallic construction. One assembly includes a pair of grippers disposed in lateral relation to one another at opposite ends of the pouch. Various means are used to open a pouch so that product may be charged into it and for closing the pouch after the product has been charged into it.

The mechanical grippers of the prior art may drop the pouch if a heavy product is dropped into it because the gripping means is typically spring-loaded. The shock of impact can be sufficient to overcome the spring-loaded grip. If a heavy product is gradually charged into a pouch, the spring-loaded grip can be lost in a more gradual way but the result is the same.

This problem has been countered by increasing the strength of the springs that provide the power behind the metallic gripping surfaces of the prior art machines, but that creates the problem of forming depressions in the pouch where the gripper engages the pouch, due to the strength of the pinch required to prevent pouch dropping. These depressions mar the pouches, making them unsightly and the subject of customer complaints.

Prior art machines also employ an arcuate means for opening and closing pouches that causes the pouches to sometimes collapse upon themselves into an "S" shape. When such condition occurs, human operator intervention is required, thus defeating the purpose of the machine.

There is a need for a better pouch-holding gripper mechanism.

More particularly, there is a need for a non-metallic gripping means that does not mar the pouch.

There is also a need for a gripping means that does not reply upon springs to provide gripping power.

Perhaps the greatest need is for a gripper apparatus that increases its gripping strength in response to increased loads.

Still another need exists for a pouch opening and closing means that does not deform pouches into an "S" shape so that the need for human intervention during machine operation is reduced.

However, in view of the art considered as a whole at the time the present invention was made, it was not obvious to those of ordinary skill in the art how the needs could be met.

SUMMARY OF THE INVENTION

The long-standing but heretofore unfulfilled need for an improved pouch gripper means for a form, fill and seal machine is now met by a new, useful, and non-obvious invention.

The inventive structure includes a pouch-gripping apparatus that does not reply upon springs for its gripping power, that does not mar the pouch even when the pouch is gripped very tightly, which does not bend the pouches into an "S" shape, and which increases the strength of its grip as the weight of the product charged into the pouch increases.

In a first embodiment, the novel apparatus has a frame with a vertical mounting surface. A gripper base is mounted to the vertical mounting surface and a stationary arm is formed integrally with the base. The stationary arm projects outwardly from the base in a substantially horizontal plane in perpendicular relation to the plane of the vertical mounting surface.

The stationary arm has a distal free end that has an "L"-shape in plan view. The "L"-shape includes a vertically disposed stop wall forming a vertical wall that faces the vertical mounting surface, i.e., the stop wall and the vertical mounting surface are parallel to one another and longitudinally spaced apart from one another, approximately, by the length of the stationary arm.

A second arm is rotatably mounted to the stationary arm for pivotal movement in a vertical plane about a horizontal axis of rotation. The second arm has a position of repose where it is disposed at an acute angle, preferably, relative to the stationary arm.

A recess is formed in the distal free end of the second arm to receive a plug formed of a hard but flexible and resilient material. The plug is slightly larger than the recess so that a leading edge of the plug extends in leading relation from the recess, i.e., from the distal free end of said second arm.

The stationary arm and the second arm have a substantially common length. Accordingly, the plug bears against the vertically disposed stop wall when the second arm rotates, against the bias means, from the position of repose to a pouch-gripping position where the stationary arm and second arm are substantially parallel to one another and where the plug tightly bears against the vertically disposed stop wall.

A rim of a pouch is positioned in abutting relation to the vertically disposed stop wall when the second arm is in its angled position of repose. The rim of the pouch is sandwiched between the plug and the vertically disposed stop wall when the second arms rotates until it is substantially horizontal and substantially parallel to the second arm. The plug and the vertically disposed stop wall therefore exert pressure on the rim and the pressure increases as the weight of the pouch increases as it is filled with product because such weight will pull the pouch down, thus forcing the second arm to rotate further away from its position of repose and increasing the pressure between the plug and the stop wall.

In a second embodiment, the frame further includes a pair of linear guide rails and a sub-frame. A pair of mounting blocks slidingly engage opposite ends of the pair of linear guide rails. An actuating linkage is slidingly engaged to the sub-frame for vertical reciprocation relative to the sub-frame.

The vertical mounting surface of the first embodiment is secured to a first mounting block of the pair of mounting blocks and a first end of a first bell crank engages a lowermost end of that vertical mounting surface.

A second end of the first bell crank engages a first end of the actuating linkage.

A first end of a second bell crank engages a lowermost end of a second vertical mounting surface mounted to a second mounting block of the pair of mounting blocks and a second end of the second bell crank engages a second end of the actuating linkage.

A second gripper having a structure that is a mirror image of the gripper of the first embodiment is secured to the second vertical mounting surface. The first and second grippers alternately converge toward one another and diverge away from one another as the actuating linkage reciprocates in a vertical plane relative to the sub-frame.

An important object of the invention is to provide a pouch-gripping mechanism that does not drop a pouch when a load is charged abruptly or gradually into the pouch.

A closely related object is to accomplish the foregoing object with a pouch-gripping mechanism that does not rely upon springs to provide gripping strength.

Another object is to provide such a mechanism that does not form an unsightly imprint or otherwise mar the pouch even when the pouch is very tightly gripped.

Another important object is to provide a gripper that increases its gripping power as the weight of the pouch increases as it is being filled with product.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1A:
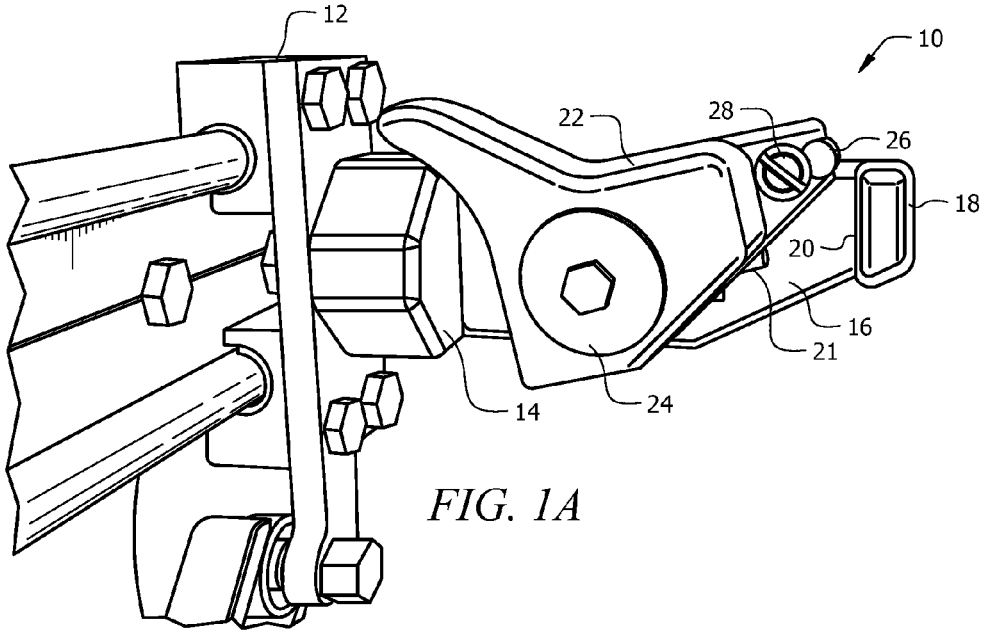
FIG. 1A is a perspective view of the novel gripper in its position of repose.
Figure 1B:
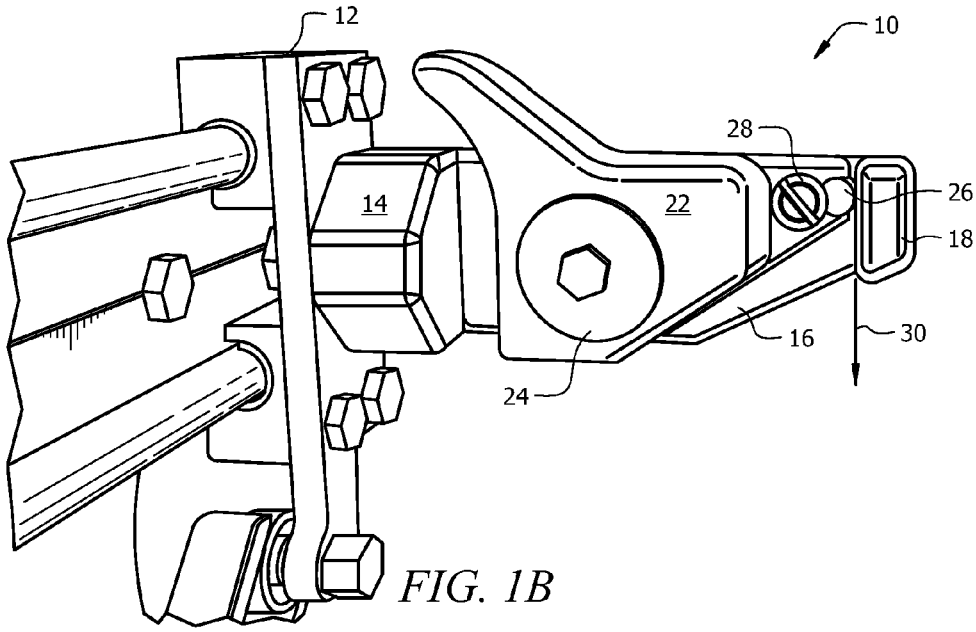
FIG. 1B is a perspective view thereof when in a pouch-gripping configuration.

FIGS. 1A and 1B depict an illustrative embodiment of the novel gripper which is denoted as a whole by the reference numeral 10.

Gripper 10 is mounted to vertical plate 12 in this illustrative embodiment, it being understood that said vertical plate can be mounted to any suitable support surface.

Gripper 10 includes base 14 that abuts and is tightly secured to vertical plate 12.

Stationary arm 16 is formed integrally with base 14 and projects outwardly therefrom in a substantially horizontal plane in perpendicular relation to the plane of vertical plate 12. Distal free end 18 of arm 16 has an "L"-shape best seen in plan view. Stationary arm 16 is preferably formed of white FDA POM plastic.

The transversely extending part of the "L"-shaped distal free end of stationary arm 16 forms a vertical wall that faces vertical plate 12. For convenience, that vertical wall is referred to as stop wall 20.

Second arm 22 is rotatably mounted to stationary arm 16 at pivot point 24 for pivotal movement in a vertical plane about a horizontal axis of rotation.

More particularly, an axle, not depicted, is transversely disposed relative to the plane of stationary arm 16 and second arm 22 and interconnects said arms to one another, said axle enabling the pivotal connection between stationary arm 16 and second arm 22.

An FDA silicone rubber plug 26 is secured to the distal free end of second arm 22. More particularly, as depicted, plug 26 fits securely within a recess formed in said distal free end of said second arm and is held against movement in said recess by screw 28 having a tool-engageable head so that it can be re-tightened as needed.

Plug 26 is slightly larger than the recess within which it fits so that a leading edge of said plug extends in leading relation from said recess as depicted in FIG. 1A.

Torsion spring 21 wraps around the above-mentioned axle and is under tension when second arm 22 in its angled position as depicted in FIG. 1A. A rigid bar, not depicted, is lowered to engage the upwardly-projecting or trailing part of second arm 22, causing the leading part of second arm 22 to pivot upwardly into its pivoted, FIG. 1A position.

As best understood by comparing FIGS. 1A and 1B, plug 26 bears against transversely-extending stop wall 20 when second arm 22 rotates from its FIG. 1A position to its FIG. 1B position. The undepicted rigid bar, when lifted, allows torsion spring 21 to unload, returning second arm 22 to its position of repose as depicted in FIG. 1B. The counterpart of second arm 22 is simultaneously opened and closed in the same way.

When the rim of a pouch, not depicted, is positioned in abutting relation to stop wall 20, i.e., between plug 26 and stop wall 20 when gripper 10 is in its FIG. 1B position, a downward force, represented in FIG. 1B by directional arrow 30, increases the pressure between plug 26 and stop wall 20 as second arm 22 rotates about pivot point 24. The amount of pressure increases in direct proportion to the weight of the pouch. Accordingly, unlike the spring-reliant mechanisms of the prior art, if an extraordinarily heavy product is dropped into a pouch, the extra weight merely increases the force of the grip exerted upon the rim of the pouch by plug 26 and stop wall 20.

Advantageously, plug 26 and stop wall 20 leave no mark or impression of any kind on said pouch even when a pouch is weighted to its maximum capacity.

Figure 2:
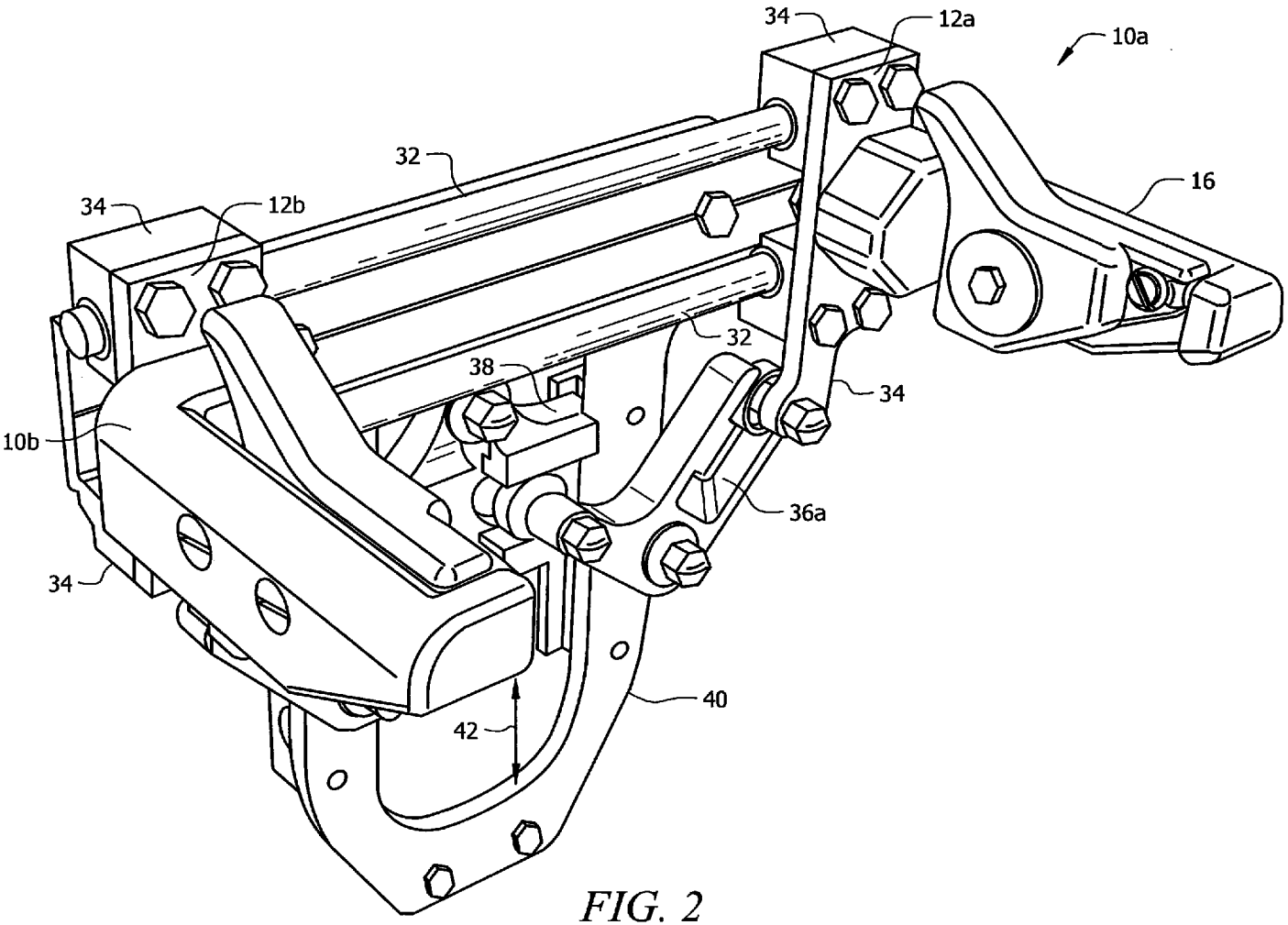
FIG. 2 is a perspective view of a double gripper having linear movement.

FIG. 2 depicts a double gripper assembly having linear movement. Gripper 10*a* has the same structure as gripper 10 depicted in FIGS. 1A and 1B and gripper 10*b* is a mirror image thereof. As depicted, vertical plates 12*a* and 12*b* are interconnected to one another by a pair of linear guide rails, collectively denoted 32.

Mounting blocks, collectively denoted 34, slidingly engage opposite ends of linear guide rails 32. A first, outboard end of bell crank 36*a* engages the lowermost end of vertical plate 12*a*. A second, inboard end of bell crank 36*a* engages a first side of actuating linkage 38 which is mounted to sub-frame 40. Vertical plate 12*b*, not depicted, is engaged by a first, outboard end of mirror image bell crank 36*b*, also not depicted. A second, inboard end of bell crank 36*b* engages a second side of actuating linkage 38. Both parts 12*b* and 36*b* are hidden due to the perspective of FIG. 2.

Figure 3A:
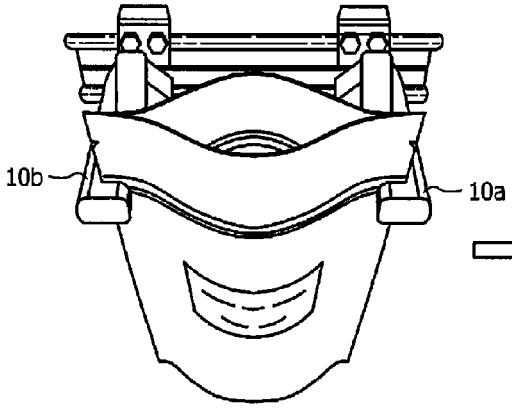
FIG. 3A is a perspective view of a double gripper when holding a large pouch open.
Figure 3B:
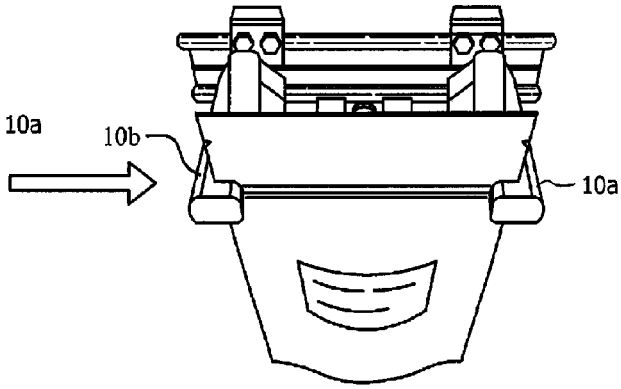
FIG. 3B is a perspective view of a double gripper when holding a large pouch closed.
Figure 4A:
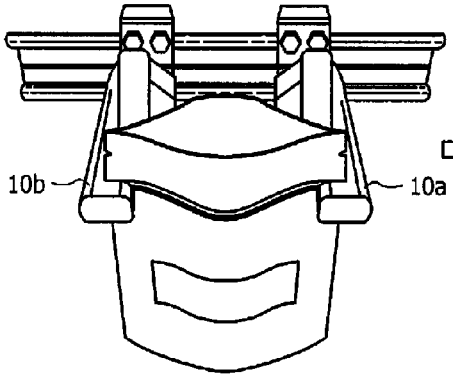
FIG. 4A is a perspective view of a double gripper when holding a small pouch open.
Figure 4B:
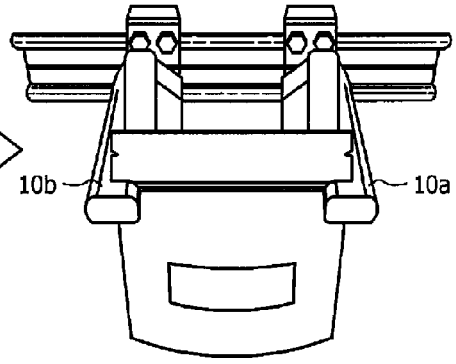
FIG. 4B is a perspective view of a double gripper when holding a small pouch closed.

As actuating linkage 38 reciprocates relative to sub-frame 40 in a vertical plane as indicated by double-headed directional arrow 42, grippers 10*a* and 10*b* alternately converge toward one another and diverge away from one another as depicted in FIGS. 3A and 3B for a relatively large pouch and as depicted in FIGS. 4A and 4B for a relatively small pouch. The novel structure thus provides easy large pouch to small pouch changeover. Advantageously, the same mechanism slides to open and close each pouch in the manner depicted. The novel linear motion performs better than prior art arc motion systems because such arc motion systems tend to force the pouch to move into an "S"-shaped configuration as mentioned earlier.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A pouch-gripping apparatus, comprising:

a frame including a vertical mounting surface;

a base mounted to said vertical mounting surface;

a stationary arm formed integrally with said base, projecting outwardly therefrom in a substantially horizontal plane in perpendicular relation to the plane of said vertical mounting surface;

said stationary arm having a distal free end;

said distal free end having an "L"-shape;

said "L"-shape of said distal free end including a vertically disposed stop wall, said stop wall forming a vertical wall that faces said vertical mounting surface;

a second arm rotatably mounted to said stationary arm for pivotal movement in a vertical plane about a horizontal axis of rotation;

a plug secured to a distal free end of said second arm;

a recess formed in said distal free end of said second arm to receive said plug;

said plug being slightly larger than said recess so that a leading edge of said plug extends in leading relation from said recess;

said second arm having a position of repose where said second arm is disposed at an angle relative to said stationary arm;

said stationary arm and said second arm having a substantially common length, said plug bearing against said vertically disposed stop wall when said second arm rotates from said position of repose to a position where said second arm is in a substantially horizontal position;

whereby a rim of a pouch is positioned in abutting relation to said vertically disposed stop wall when said second arm is in said position of repose;

whereby said rim of said pouch is sandwiched between said plug and said vertically disposed stop wall when said second arm is rotated into said substantially horizontal position, said plug and said vertically disposed stop wall exerting pressure on said rim; and whereby said pressure increases as a weight of said pouch increases because said weight causes further rotation of said second arm thereby increasing pressure between said plug and said vertically disposed stop wall.

2. The pouch-gripping apparatus of claim 1, further comprising:

said frame further including a pair of linear guide rails and a sub-frame;

an actuating linkage slidingly engaged to said sub-frame for vertical reciprocation relative to said sub-frame;

a pair of mounting blocks slidingly engaged to opposite ends of said pair of linear guide rails;

said vertical mounting surface secured to a first mounting block of said pair of mounting blocks;

a first, outboard end of a first bell crank engaging a lowermost end of said vertical mounting surface;

a second, inboard end of said first bell crank engaging a first side of said actuating linkage;

a first, outboard end of a second bell crank engaging a lowermost end of a second vertical mounting surface that is mounted to a second mounting block of said pair of mounting blocks;

a second, inboard end of said second bell crank engaging a second side of said actuating linkage;

a second gripper secured to a second vertical mounting surface that is secured to a second mounting block of said pair of mounting blocks;

said first and second grippers alternately converging toward one another and diverging away from one another as said actuating linkage reciprocates in a vertical plane relative to said sub-frame.

3. The apparatus of claim 1, further comprising:

said stationary arm formed of FDA POM plastic.

4. The apparatus of claim 1, further comprising:

said plug formed of silicone rubber.

5. The apparatus of claim 1, further comprising:

a screw having a tool-engageable head securing said plug within said recess.

6. The apparatus of claim 1, further comprising:

a bias means for holding said second arm in said position of repose.

* * * * *